United States Patent [19]

Wilson, Jr.

[11] 4,050,546

[45] Sept. 27, 1977

[54] ELEVATOR STRUCTURE

[75] Inventor: Woodrow Wilson, Jr., Brownsville, Tex.

[73] Assignee: Deepwater Salvage, Inc., Brownsville, Tex.

[21] Appl. No.: 716,063

[22] Filed: Aug. 19, 1976

[51] Int. Cl.[2] ..... B66B 9/08

[52] U.S. Cl. ..... 187/12; 187/24; 187/42

[58] Field of Search ..... 187/10, 95, 12-14, 187/24, 25, 42-44

[56] References Cited

U.S. PATENT DOCUMENTS

| | | | |
|---|---|---|---|
| 457,645 | 8/1891 | Hancock | 187/24 |
| 2,207,544 | 7/1940 | Knudsen | 187/12 |
| 2,227,111 | 12/1940 | Sturm | 187/24 |
| 2,270,735 | 1/1942 | Knudsen | 187/12 |
| 2,619,196 | 11/1952 | Scott | 187/14 |
| 2,674,347 | 4/1954 | Thompson | 187/12 |
| 2,824,623 | 2/1958 | Nord et al. | 187/12 |
| 3,121,476 | 2/1964 | Mazzarelli | 187/12 |
| 3,833,092 | 9/1974 | Flinchbaugh | 187/12 |

*Primary Examiner*—Evon C. Blunk
*Assistant Examiner*—Jeffrey V. Nase
*Attorney, Agent, or Firm*—Fishburn, Gold & Litman

[57] ABSTRACT

An elevator structure for use on an inclined stairway extending between a lower landing and an upper landing for movement of passengers and/or freight between the landings and includes an elevator car having side members movable along respective rail members mounted on stair stringers each of which extends between the lower landing and the upper landing. The side members of the elevator housing are each moved along the respective rail member in response to movement of ball bearing screw structures having nut members mounted on and driven by balls operating in grooved shafts selectively rotated by a reversible drive motor.

5 Claims, 7 Drawing Figures

ELEVATOR STRUCTURE

The present invention relates to power elevators and more particularly to an elevator structure for use on an inclined stairway extending between upper and lower landings for movement of passengers and/or freight therebetween.

The principal objects of the present invention are: to provide an elevator structure for use on an inclined stairway for movement of passengers and/or freight between upper and lower landings; to provide such an elevator structure wherein drive means for movement of the elevator structure includes means for retaining the elevator structure in position in the event of a power failure; to provide such an elevator structure having novel screw and nut means that provides positive moving of the elevator structure between the upper and lower landings; to provide such an elevator structure particularly adapted for installation on existing stairways with an absence of obstructions or interference with other use; to provide such an elevator structure particularly adapted to permit easy access to and from the elevator structure at either the upper or lower landing; to provide such an elevator structure wherein the elevator structure and the support therefor is adjustable so that an elevator floor will be horizontal when the elevator structure is in use; to provide such an elevator structure wherein the floor is pivotally mounted so that the floor may be moved to a storage position to permit use of the stairway; and to provide such an elevator structure which is economical to manufacture and install, durable in construction, positive in operation, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include an exemplary embodiment of the present invention and illustrates various objects and features of the elevator structure.

Figures 1, 2, 3:
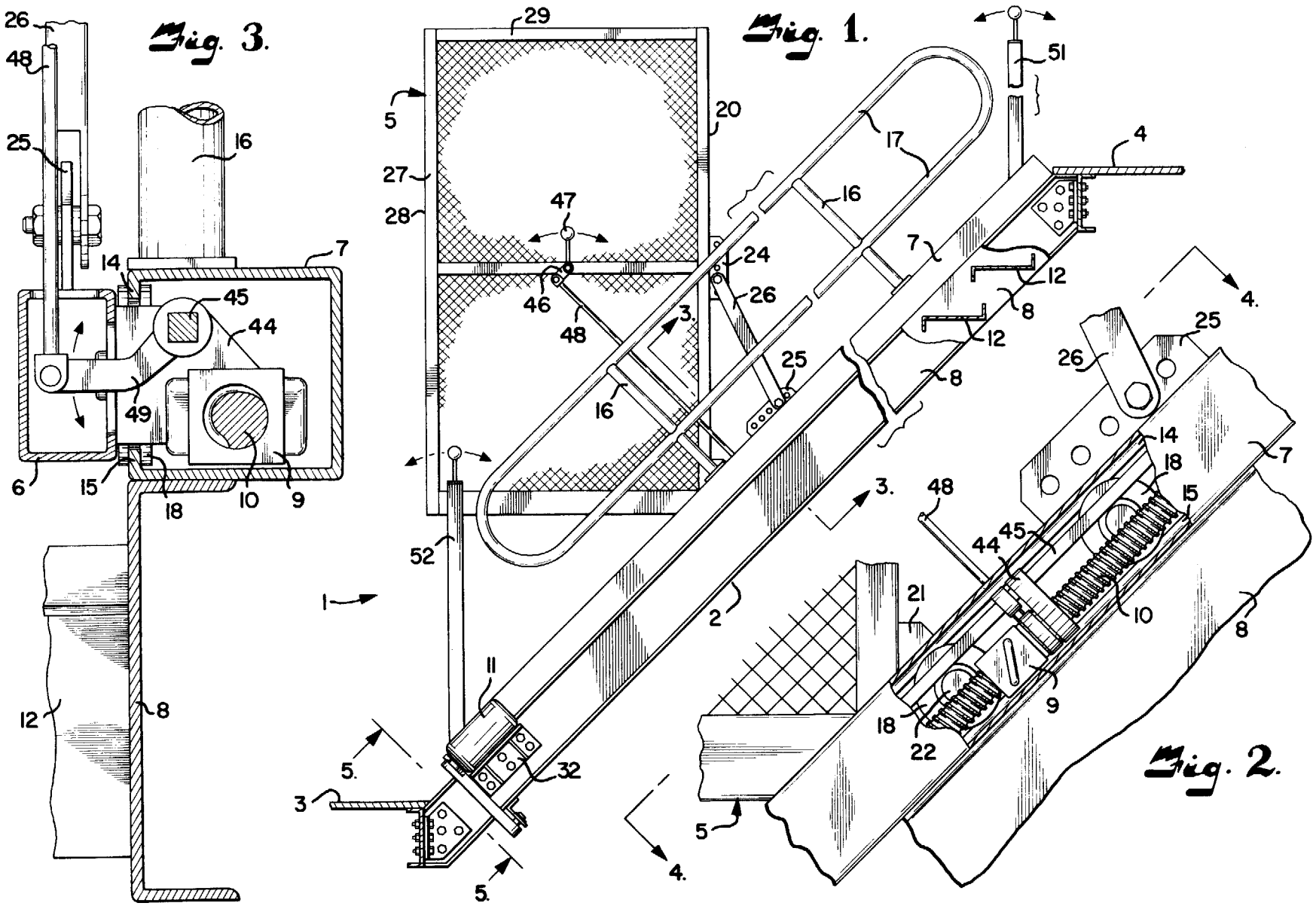
FIG. 1 is a side elevational view of an elevator structure embodying features of the present invention.
FIG. 2 is an enlarged fragmentary side elevational view of a rail member with portions broken away to better illustrate means for moving the elevator structure along a stairway.
FIG. 3 is a further enlarged fragmentary transverse sectional view through the rail member and taken on line 3—3 of FIG. 1.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring more in detail to the drawings:

In the disclosed embodiment of the present invention, the reference numeral 1 designates generally an elevator structure for use on an inclined stairway 2 extending between a lower landing 3 and an upper landing 4 and particularly adapted for movement of passengers and/or freight between the landings 3 and 4. The elevator structure 1 includes an elevator car housing or cage 5 having side members 6 each movable along a respective one of rail members 7 each mounted on stair stringers 8 which extend between the lower landing 3 and the upper landing 4. The side members 6 of the elevator housing 5 are each moved along the respective rail members 7 in response to movement of nut members 9 mounted on threaded shafts 10 selectively rotated by a reversible drive motor 11.

The stairway 2 may be any suitable structure either existing or new construction. The stringers 8 are laterally spaced and extend between and have opposite ends thereof suitably supported on the structure of the upper and lower landings. The stairway 2 has suitable tread members 12 extending between and having opposite ends thereof supported on the stringers 8, as is conventional.

The rail members 7 are laterally spaced and are mounted on the upper portion or flange of the stringers 8. The rail members 7 are generally C-shaped members in cross section and have opposed guide flanges 14 and 15, for a purpose later described. It is desirable that the stairway 2 be suitable for use by personnel when not using the elevator structure 1. Therefore, a suitable hand rail is mounted on the rail members 7 and includes a plurality of longitudinally spaced posts 16 and spaced rails 17 as in any conventional hand rail.

The elevator structure 1 includes means for guiding the elevator housing 5 between the landings 3 and 4. In the illustrated embodiment, the side members 6 are each mounted on and extend laterally from the elevator car or cage 5 and are each positioned adjacent a respective one of the rail members 7. Each of the side members 6 has a plurality of longitudinally spaced rollers 18 rotatably mounted thereon, as in suitable bearings. Each of the rollers 18 are in engagement with guide flanges 14 and 15 of the respective rail member 7. The illustrated rollers 18 each have a groove or recess in the periphery thereof and receive therein the opposed flanges 14 and 15 of the respective rail member 7.

The side members 6 each have one portion 19 thereof pivotally mounted on a leading side 20 of the elevator car 5. In the illustrated embodiment, the elevator car 5 has lower side brackets 21 thereon which are positioned adjacent a lower edge of the elevator car 5. The one end portion 19 of each of the side members 6 is pivotally mounted on the respective lower bracket 21 as by having an axle member 22 of one of the rollers 18 extending through the bracket 21.

The elevator car 5 and the other end portion 23 of each of the side members 6 are connected together whereby the elevator car 5 is supported on the side members 6. In the illustrated structure, each side of the elevator car 5 has an upper bracket 24. The other end portion 23 of the side members 6 have end brackets 25 mounted thereon. Each side of the elevator car 5 has a connection member 26 extending between and having opposite ends thereof connected to the upper bracket 24 on the elevator car 5 and to the end bracket 25 on the other end portion 23 of the respective side member 6.

It is desirable that the elevator car 5 be vertical when in use, therefore, the connection between the elevator car 5 and the other end portion 23 of the side members 6 is adjustable to compensate for the angle of the stairway 2, as by the connection members 26 being telescoping. However, in the illustrated embodiment, each of the upper brackets 24 and each of the end brackets 25 have a plurality of spaced apertures therein each adapted to receive a suitable fastening member, such as nuts and bolts.

The elevator car 5 may be any suitable structure adapted to support passengers and/or freight during movement between the landings 3 and 4. The illustrated elevator car 5 includes opposite side panels 27 each having a leading side 20 and a trailing side 28. A top panel 29 extends between the upper edge portion of the opposite side panels 27 thereby connecting same together.

The elevator car 5 includes a floor member 30 extending between and supported on a lower edge portion of the opposite side panels 27. The floor member 30 and one of the opposite side panels 27 includes cooperating means for permitting pivotal movement of the floor member 30 toward an upright storage position adjacent the one side panel 27 of the elevator housing 5. In the illustrated embodiment, suitable hinge members 31 connect one side portion of the floor member 30 and the one side panel 27 of the elevator car 5.

The drive means for selectively moving the elevator car 5 along the rail members 7 between the landings 3 and 4 includes the drive motor 11 and the pair of threaded shafts 10. In the illustrated embodiment, the drive motor 11 is mounted on a suitable support bracket 32 which is positioned adjacent a lower end of one of the stringers 8. The threaded shafts 10 are each positioned within the rail members 7 and have opposite end portions thereof rotatably supported thereon, as in suitable bearings (not shown).

Figures 4, 5, 6, 7:
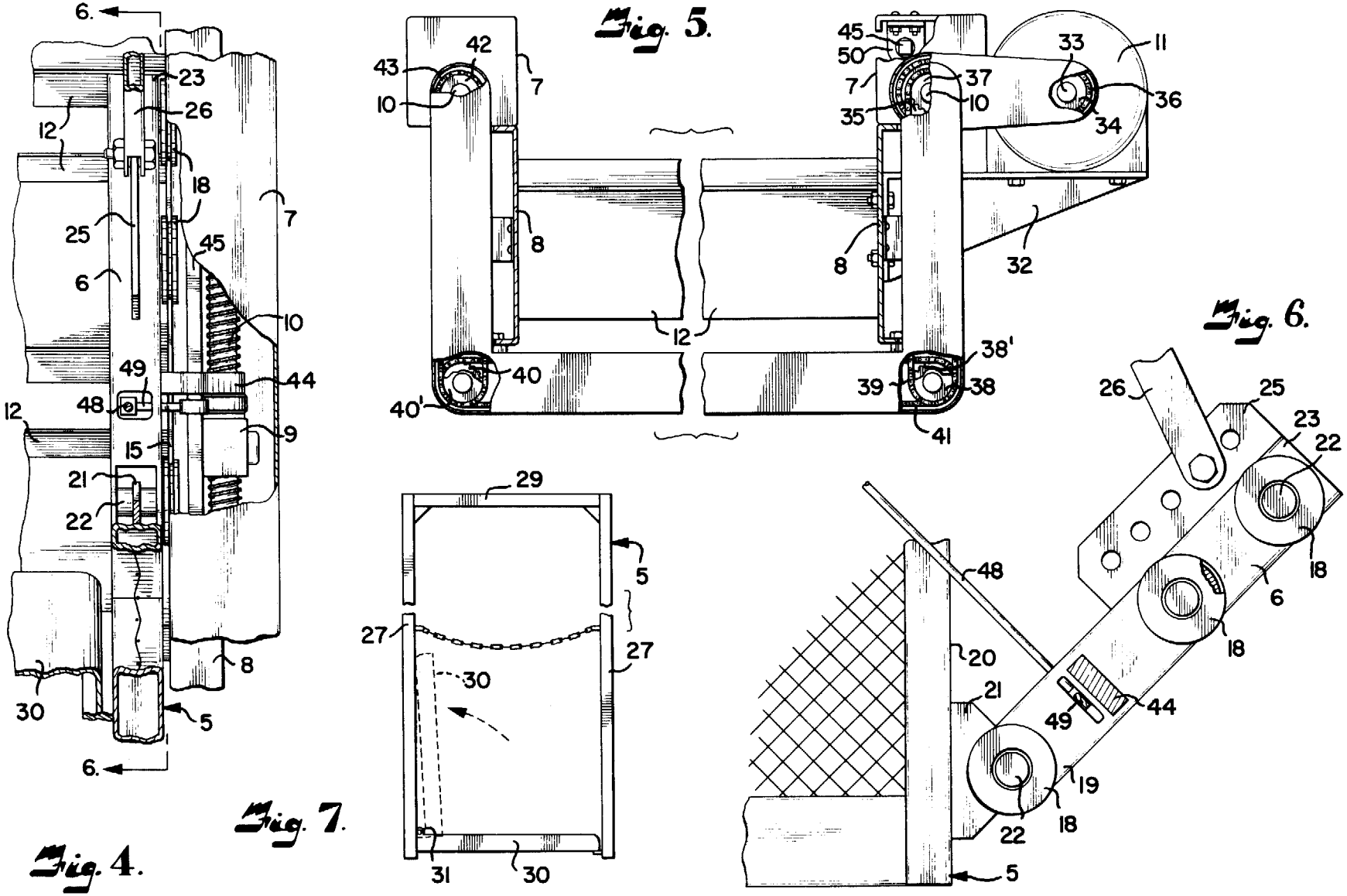
FIG. 4 is an enlarged fragmentary top plan view of the rail member and an elevator side member taken on line 4—4 of FIG. 2 and with portions broken away to better illustrate the means for moving the elevator structure along the stairway.
FIG. 5 is an enlarged transverse sectional view taken on line 5—5 of FIG. 1 and showing the driving connection between a drive motor and the means for moving the elevator structure along the stairway.
FIG. 6 is an enlarged fragmentary side elevational view of the elevator side member and taken on line 6—6 of FIG. 4.
FIG. 7 is a fragmentary front elevational view of an elevator housing with a floor member shown in a storage position in broken lines.

FIG. 5 illustrates the driving connection between the drive motor 11 and the threaded shafts 10. The drive motor 11 is operative to rotate a motor or drive shaft 33 having a drive sprocket 34 mounted thereon. One of the threaded shafts 10 has a driving sprocket 35 mounted thereon and which is positioned adjacent and aligned with the drive sprocket 34 of the drive motor 11. An endless chain 36 extends around the sprockets 34 and 35 so that the one threaded shaft 10 is rotated in response to operation of the drive motor 11.

The other threaded shaft 10 is rotated with the one threaded shaft 10 and preferably at the same speed. In the illustrated embodiment, the one threaded shaft 10 has a second sprocket 37 mounted thereon and spaced from the driving sprocket 35. The second sprocket 37 is operative to drive a first sprocket 38 by means of an endless chain 39. The first sprocket 38 and a second sprocket 38' are suitably mounted in side-by-side relation for rotation together on the stringer 8 and positioned below the threaded shaft 10, as by being rotatably mounted on a bracket depending from the stringer 8. The second sprocket 38' is operative to drive a third sprocket 40 by means of an endless chain 41 extending around the sprockets 38' and 40. The third sprocket 40 and a fourth sprocket 40' are suitably mounted in side-by-side relation for rotation together on the other stringer 8 below the other threaded shaft 10, as by being rotatably mounted on a bracket depending from the other stringer 8.

The fourth sprocket 40' is operative to drive a driving sprocket 42 mounted on the other threaded shaft 10, as by means of an endless chain 43 whereby the threaded shafts 10 are each driven at the same speed and in the same direction.

The drive means for selectively moving the elevator housing 5 along the rail members 7 between the landings 3 and 4 preferably includes ball bearing screw mechanisms and have a pair of nut members 9 each mounted on a respective one of the threaded shafts 10. Each of the nut members 9 is connected to a respective one of the side members 6 mounted on the elevator car 5, as by a respective support bracket 44, so that the movement of the nut members 9 effects movement of the side members 6 and thereby movement of the elevator car 5.

In the structure illustrated, the nut members 9 and the threaded shafts 10 have matching helical grooves or races. The nut members 9 each have a plurality of ball bearings therein and as the threaded shafts rotate and the ball bearings reach the trailing end of the respective nut members 9, they are deflected or guided from the respective pitch contact by means of a return tube and are returned to a leading end of the circuit within the nut members. The cycle then resumes and the ball bearings recirculate continuously.

The elevator structure 1 includes control means mounted on the elevator car 5 and on one of the rail members 7 and the control means is operatively connected to the drive means for selectively activating same. The illustrated control means includes an elongated non-round control shaft 45 positioned substantially parallel with and having opposite ends thereof rotatably mounted on the one rail member 7. The elevator car 5 has means mounted thereon and operatively connected to the control shaft 45 for selectively rotating same in one of a first direction or a second direction.

In the illustrated embodiment, a lever member 46 has an intermediate portion thereof pivotally mounted on the elevator car 5. A handle 47 is mounted on one end of the lever member 46 and a connection member 48 has one end thereof pirovally mounted on the other end of the lever member 46. The other end of the connection member 48 is pivotally mounted on one end of an arm 49 having the other end portion thereof in engagement with the control shaft 45.

In the illustrated embodiment, the non-round control shaft 45 is a square bar and the arm 49 has a square aperture in the other end portion thereof whereby the arm 49, connection member 48, and lever member 46 are movable longitudinally along the control shaft 45 and raising or lowering of the one end of the arm 49 turns or rotates the control shaft 45 in a first or second direction.

The control means includes suitable switch means 50 operated by rotation of the control shaft 45 and the switch means 50 is operatively connected to the drive motor 11 for selectively activating same in response to rotation or turning of the control shaft 45. In the illustrated embodiment, the switch means 50 is mounted on the one rail member 7 and is electrically connected to the drive motor 11.

The control means also includes means mounted on opposite ends of the rail member 7 having the control shaft 45 therein and each means are operatively connected to the control shaft 45 for selectively rotating same in one of a first direction and a second direction. In the illustrated embodiment, upper and lower control stands 51 and 52 respectively, each have an arm and a connection member therein which are similar to the arm 49 and the connection member 48 mounted on the elevator car 5. Each of the control stands 51 and 52 has a lever member connected to the respective connection member and a handle on the lever member for moving the connection member within the respective control stand and thereby selectively rotating the control shaft 45.

The ball bearing drive elevator is a low friction, smooth operating long life structure. The movement of the elevator car is free of jerks in starting, stopping and travel. The pitch of the nut and screw of the ball bearing drive is such that it is similar to a worm gear drive and it serves as its own brake and when the car is stopped it is held against further movement until the motor drive is again energized. The movement of the car is positive in both up and down directions. The elevator structure has all moving parts enclosed and meets all safety requirements.

It is to be understood that while I have illustrated and described one form of my invention, it is not to be limited to the specific form or arrangement of parts herein described and shown.

What I claim and desire to secure by Letters Patent is:

1. An elevator structure for use on an inclined stairway extending between a lower landing and an upper landing, said elevator structure comprising:

a. an elevator car;

b. a pair of laterally spaced rail members extending between a lower landing and an upper landing;

c. means mounted on said elevator car and movable along said rail members for guiding said elevator car between the lower landing and the upper landing;

d. drive means mounted on said rail members and operatively connected to said elevator for selectively moving said elevator car along said rail members, said drive means including a pair of ball screws;

e. control means mounted on said elevator car and on one of said rail members and operatively connected to said drive means for selectively activating same, said control means including:

1. an elongated control shaft positioned substantially parallel with and having opposite ends thereof rotatably mounted on said one of said rail members;

2. means mounted on said elevator car and operatively connected to said control shaft for selectively rotating same in one of a first direction and a second direction;

3. means mounted on opposite ends of said one rail member and each operatively connected to said control shaft for selectively rotating same in one of a first direction and a second direction; and 4. switch means operated by rotation of said control shaft and operatively connected to said drive means for selectively activating same in response to rotation of said control shaft.

2. An elevator structure as set forth in claim 1 wherein:

a. said drive means includes a drive motor; and b. said ball screws include:

1. a pair of elongated threaded shafts each positioned adjacent a respective one of said rail members and operatively connected to said drive motor; and 2. a pair of nut members each mounted on a respective one of said elongated threaded shafts, said nut members each being connected to said elevator car whereby rotation of said elongated threaded shafts effects movement of said elevator car.

3. An elevator structure for use on an inclined stairway extending between a lower landing and an upper landing, said elevator structure comprising:

a. an elevator car;

b. a pair of laterally spaced rail members extending between a lower landing and an upper landing;

c. means mounted on said elevator car and movable along said rail members for guiding said elevator car between the lower landing and the upper landing;

d. drive means mounted on said rail members and operatively connected to said elevator car for selectively moving said elevator car along said rail members, said drive means including a pair of ball screws;

e. control means mounted on said elevator car and on one of said rail members and operatively connected to said drive means for selectively activating same;

f. said elevator car includes opposite side panels each having an upper edge portion and a lower edge portion;

g. said elevator car includes a floor member extending between and supported on the lower edge portion of the opposite side panels of said elevator car;

h. said floor member and the lower edge portion of one of the opposite side panels includes cooperating means for permitting pivotal movement of said floor member toward the one side panel of said elevator car;

i. said rail members are each C-shaped members and include a pair of opposed guide flanges;

j. said means for guiding said elevator car between the lower landing and the upper landing includes:

1. a pair of side members mounted on said elevator car and each positioned adjacent a respective one of said rail members, said side members each being connected to said drive means;

2. a first and second plurality of longitudinally spaced rollers each mounted on a respective one of said side members, each of said rollers being in engagement with said opposed guide flanges of a respective one of said rail members;

k. each of the opposite side panels of said elevator car includes a leading side and a trailing side;

l. said elevator car and said side members include cooperating means for pivotally mounting one end of each of said side members on the leading side of a respective one of the opposite side panels of said elevator car; and m. each of the opposite side panels of said elevator car and said side members include cooperating means for connecting said elevator car to the other end of each of said side members whereby said elevator car is supported on said side members.

4. An elevator structure as set forth in claim 3 wherein:

a. said drive means includes a drive motor mounted on said stairway;

b. said'ball screws of said drive means comprises:

1. a pair of elongated threaded shafts each positioned adjacent and rotatably mounted on a respective one of the rail members and operatively connected to said drive motor; and 2. a pair of nut members each mounted on and movable along a respective one of said elongated threaded shafts, said nut members each being connected to a respective one of said side members mounted on said elevator car whereby rotation of said elongated threaded shafts effect movement of said elevator car.

5. An elevator structure for use on an inclined stairway extending between a lower landing and an upper landing, said elevator structure comprising:

a. an elevator car;

b. a pair of laterally spaced rail member extending between a lower landing and an upper landing;

c. means mounted on said elevator car and movable along said rail members for guiding said elevator car between the lower landing and the upper landing;

d. drive means mounted on said rail members and operatively connected to said elevator car for selectively moving said elevator car along said rail members, said drive means including a pair of ball screws;

e. control means mounted on said elevator car and on one of said rail members and operatively connected to said drive means for selectively activating same;

f. said rail members are each C-shaped members and include a pair of opposed guide flanges;

g. said means for guiding said elevator car between the lower landing and the upper landing includes:

1. a pair of side members mounted on said elevator car and each positioned adjacent a respective one of said rail members, said side members each being connected to said drive means;

2. a first and second plurality of longitudinally spaced rollers each mounted on a respective one of said side members, each of said rollers being in engagement with said opposed guide flanges of a respective one of said rail member;

h. said elevator car has opposite sides with including a leading portion and a trailing portion;

i. said elevator car and said side members include cooperating means for pivotally mounting one end of each of said side members on the leading portion of a respective one of the opposite sides of said elevator car; and j. each of the opposite sides of said elevator car and said side members include cooperating means for connecting said elevator car to the other end of each of said side members whereby said elevator car is supported on said side members.

* * * * *